US005960514A

United States Patent [19]

Miller et al.

[11] Patent Number: 5,960,514

[45] Date of Patent: Oct. 5, 1999

[54] WHEEL DRIVEN SUCTION NOZZLE

[75] Inventors: Daniel R. Miller, Canton; Vincent L. Weber, North Lawrence; Douglas C. Barker, North Canton, all of Ohio

[73] Assignee: The Hoover Company, North Canton, Ohio

[21] Appl. No.: 08/967,639

[22] Filed: Nov. 10, 1997

[51] Int. Cl.[6] ..... A47L 5/00; A47L 9/04

[52] U.S. Cl. ..... 15/388; 15/27; 15/41.1; 15/48.1; 15/52.1; 15/98

[58] Field of Search ..... 15/27, 41.1, 48.1, 15/52.1, 98, 388

[56] References Cited

U.S. PATENT DOCUMENTS

| | | | |
|---|---|---|---|
| 166,422 | 8/1875 | Spencer | 15/41.1 |
| 167,164 | 8/1875 | Gladding | 15/41.1 |
| 298,352 | 5/1884 | Conde et al. | 15/27 |
| 306,008 | 9/1884 | Drew | 15/41.1 |
| 329,374 | 10/1885 | Drew | 15/41.1 |
| 336,728 | 2/1886 | Mack | 15/79.1 |
| 523,339 | 7/1894 | Gere | 15/41.1 |
| 548,659 | 10/1895 | Rogers | 15/79.1 |
| 598,602 | 2/1898 | Keesee | 15/48.1 |
| 824,761 | 7/1906 | Townsend | 56/253 |
| 837,936 | 12/1906 | King | 15/41.1 |
| 894,011 | 7/1908 | Kampfe | 15/48 |
| 901,978 | 10/1908 | Mally et al. | 15/52 |
| 907,755 | 12/1908 | De Spain | 15/79.1 |
| 909,366 | 1/1909 | Chaplin | 15/41.1 |
| 960,879 | 6/1910 | Friedman | 15/98 |
| 1,043,024 | 10/1912 | Moorhead | 15/415.1 |
| 1,190,798 | 7/1916 | Quist | 15/341 |
| 1,204,741 | 11/1916 | Bunker | 15/92 |
| 1,230,489 | 6/1917 | Katako | 15/41.1 |
| 1,801,620 | 4/1931 | Bettman | 15/344 |
| 1,892,961 | 1/1933 | Parker | 15/83 |
| 2,329,222 | 9/1943 | Schlegel, Jr. | 15/230.12 |
| 2,380,634 | 7/1945 | Daniels | 15/48 |
| 2,650,385 | 9/1953 | De Michel | 15/235 |
| 2,803,097 | 8/1957 | Mockiewicz | 15/230.15 |
| 2,910,721 | 11/1959 | Burrage | 15/388 X |
| 2,962,740 | 12/1960 | Plantholt | 15/41.1 |
| 3,003,170 | 10/1961 | Lathrop | 15/41.1 |
| 3,007,189 | 11/1961 | Crane | 15/230 |
| 3,643,276 | 2/1972 | Worwag | 15/52.1 |
| 3,789,454 | 2/1974 | Drappeu et al. | 15/41.1 |
| 3,899,801 | 8/1975 | Carrier | 16/45 |
| 3,981,042 | 9/1976 | Carrier | 16/47 |
| 5,400,467 | 3/1995 | Hwang | 15/364 |

FOREIGN PATENT DOCUMENTS

| | | | |
|---|---|---|---|
| 515304 | 3/1921 | France | 15/388 |
| 640130 | 7/1928 | France | 15/41.1 |
| 583738 | 12/1946 | United Kingdom | 15/48.1 |
| 1023556 | 3/1966 | United Kingdom . | |

*Primary Examiner*—Mark Spisich
*Attorney, Agent, or Firm*—A. Burgess Lowe; Thomas R. Kingsbury

[57] ABSTRACT

A wheel driven suction nozzle having an upper body attached to an under body. An opening is formed at a front of the upper body which provides access to a suction cavity. An agitator covered with a fluff material is removably rotatably mounted within the cavity and extends partially out a bottom of the under body to clean and shine bare floors. A cover is hingedly mounted to the upper body and movable between an open position which provides access to the cavity and allows for removal of the agitator, and a closed position which covers the cavity and prevents removal of the agitator. A cogged front pulley is attached to one end of the agitator. A cogged belt is driven by a rear cogged pulley and engages the front pulley whereby rotation of the rear pulley rotates the agitator. A front gear is rigidly connected to the rear pulley and engages a rear gear which is rigidly connected to an axle shaft. A pipped wheel is attached to each end of the axial shaft whereby rotation of the wheels rotates the rear gear which, in turn, rotates the front gear, the rear pulley and thus the agitator.

21 Claims, 9 Drawing Sheets

WHEEL DRIVEN SUCTION NOZZLE

BACKGROUND OF THE INVENTION

1. Field of the Invention

This invention relates to floor care appliances and, more specifically, relates to a suction nozzle.

2. Summary of the Prior Art

Suction nozzles are known which include a wheel driven agitator. Also known are suction nozzles where the agitator is conveniently mounted downwardly through a hinged cover of the nozzle housing and engaged with the wheel driving structure. The use of lugged wheels on a suction nozzle is also known as is a mounting arrangement for the wheel's axle. However, heretofore, it is not known to combine these features viably in an operative, practical nozzle having a commercially advantageous form and structure.

Accordingly, it is an object of the invention to provide an improved suction nozzle.

It is a further object of the invention to utilize a simplified wheel driven agitator arrangement in a wheeled nozzle.

It is an even further object of the invention to include an improved wheel axle mounting for a wheeled nozzle.

It is a still further object of the invention to provide a downwardly mounted agitator inserted through a top opening in the nozzle housing.

It is also an object of the invention to provide the nozzle housing with a latchable hinged cover to facilitate such mounting.

It is an additional object of the invention to utilize lugged wheels on the suction nozzle which have a self cleaning attribute.

It is a still further object of the invention to provide the aforesaid suction nozzle with a fluffed material as an outer covering for the agitator.

SUMMARY OF THE INVENTION

A suction nozzle includes a front, hinged opening, cover which exposes upwardly open bottomed agitator mounting slots. The agitator is then easily mounted through the opening afforded, downwardly into the agitator slots. The agitator is driven by rearwardly disposed suction nozzle wheels whose shaft includes a fast relatively large gear. This gear meshes with a smaller forwardly disposed second shaft mounted gear to drive it at a higher rotational speed. Also fast with the second shaft is a relatively large toothed pulley which drives a cogged belt that is drivingly mounted over a smaller toothed pulley fast with the agitator. This increases the speed of the agitator a second time and, moreover, with the drive described, the agitator is fixed to rotate oppositely to the rear driving wheels. A fluffy material agitator is generally used with this nozzle since one of the major applications for it is the cleaning of bare floors. A wheel axle mounting arrangement is included which permits the nozzle to pivot relative to its hose coupling on the wheel shaft of the nozzle.

BRIEF DESCRIPTION OF THE DRAWINGS

Reference now may be had to the accompanying Drawings for a better understanding of the invention, both as to its organization and function, with the illustration being of a preferred form of the invention, but being only exemplary, and in which.

DETAILED DESCRIPTION OF THE DRAWINGS

Figure 1:
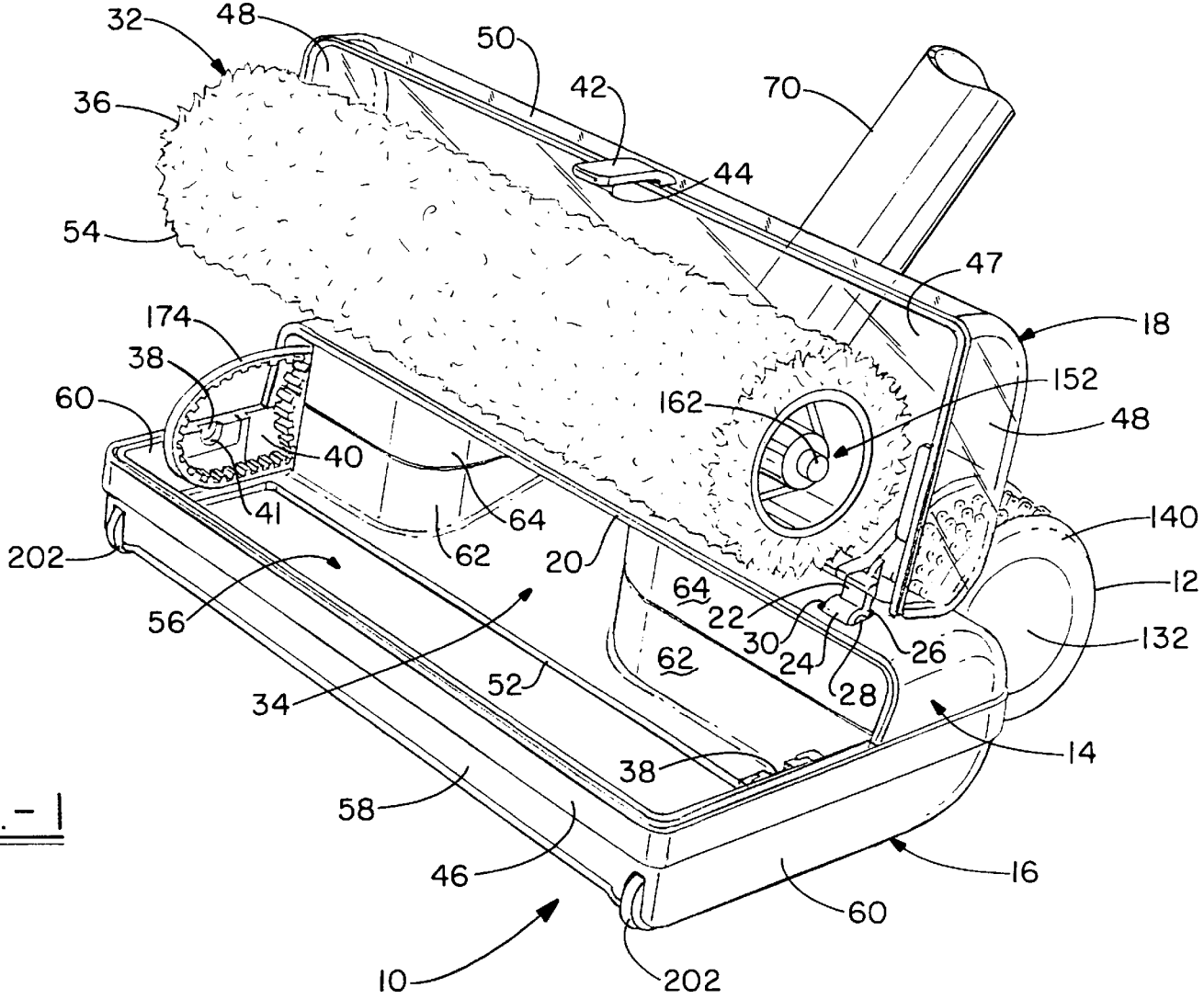
FIG. 1 is a left front perspective, partially exploded view of the invention looking downwardly and with the nozzle cover open.
Figure 2:
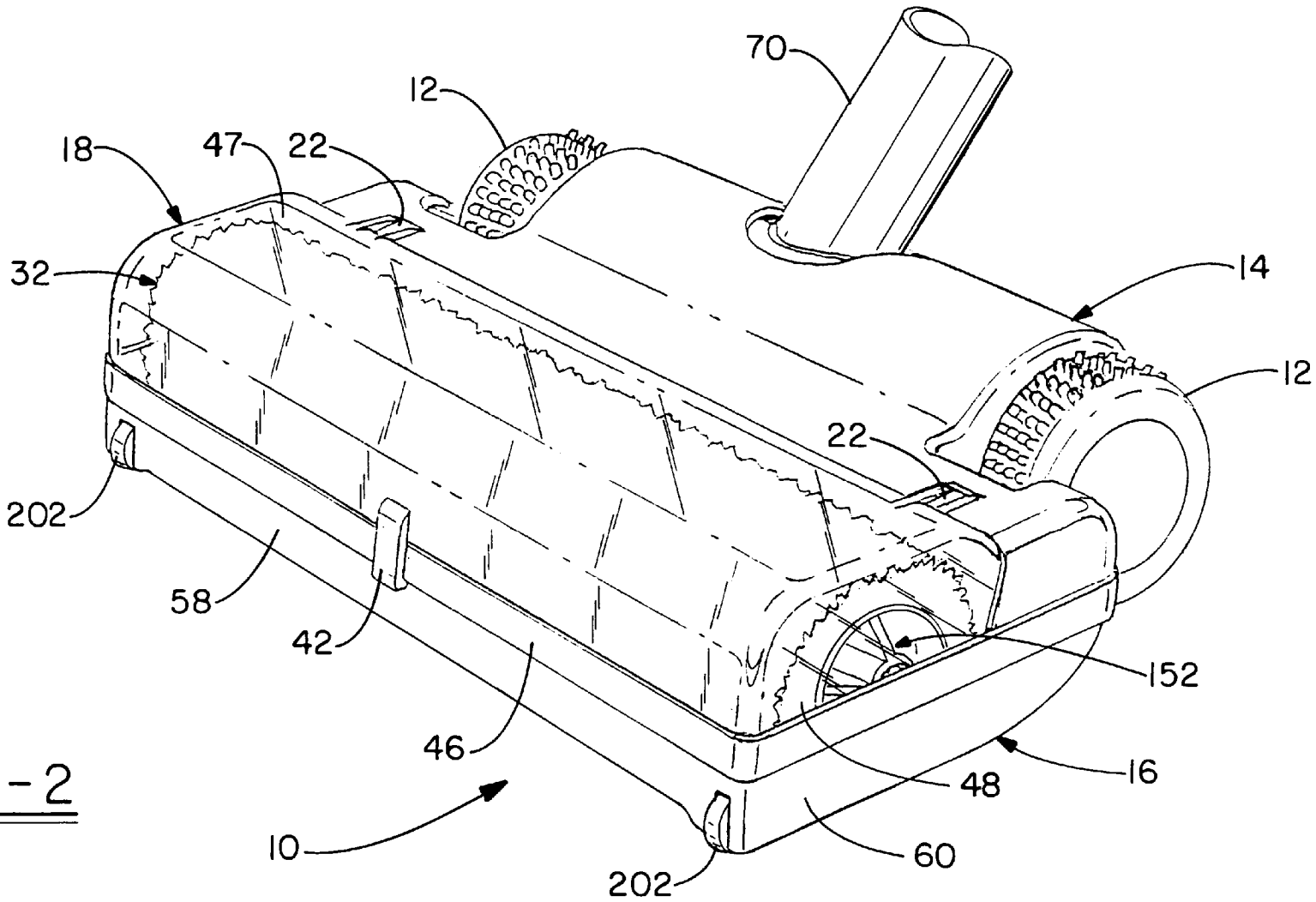
FIG. 2 is a similar view of the invention but unexploded and with the cover closed.

There is shown in FIGS. 1–2 a suction nozzle 10 which is supported at its rear by drive wheels 12, 12. These wheels are mounted between a nozzle upper body 14 and a nozzle underbody 16. A cover 18 is hingedly mounted to the nozzle upper body 14 adjacent its front edge 20 by integral hinge lugs 22, 22 each of which has front and rear curved hinge leafs 24, 26 that snap fit over a cross pintle piece 28 integral with upper body 14 and extending medially across a hinge aperture 30.

An agitator 32 is easily mounted within an opening 34 formed in suction nozzle 10 when cover 18 is hinged to open condition by having each of its bearing ends 36 each including one of a pair of stub axles 162 and 170, disposed within an upwardly opening slot 38 formed and disposed at an inside side 40 of the nozzle underbody 16. Each of the slots 38 is provided with a curved bottom 41 to easily bearingly receive one of agitator bearing end stub axles 162 or 170.

The cover 18 includes a centrally located latch 42 having a latching nose 44 that engages, in latched position, over an upper border rim 46 of nozzle underbody 16. The cover 18 also includes a top side 47, side curvilinear walls 48, 48 and a front wall 50 extending therebetween which integrally mounts latch 42.

The suction nozzle 10 also includes a suction slot 52 in nozzle under body 16 through which an outer periphery 54 of the agitator 32 conventionally extends when mounted in the suction nozzle.

Figure 3:
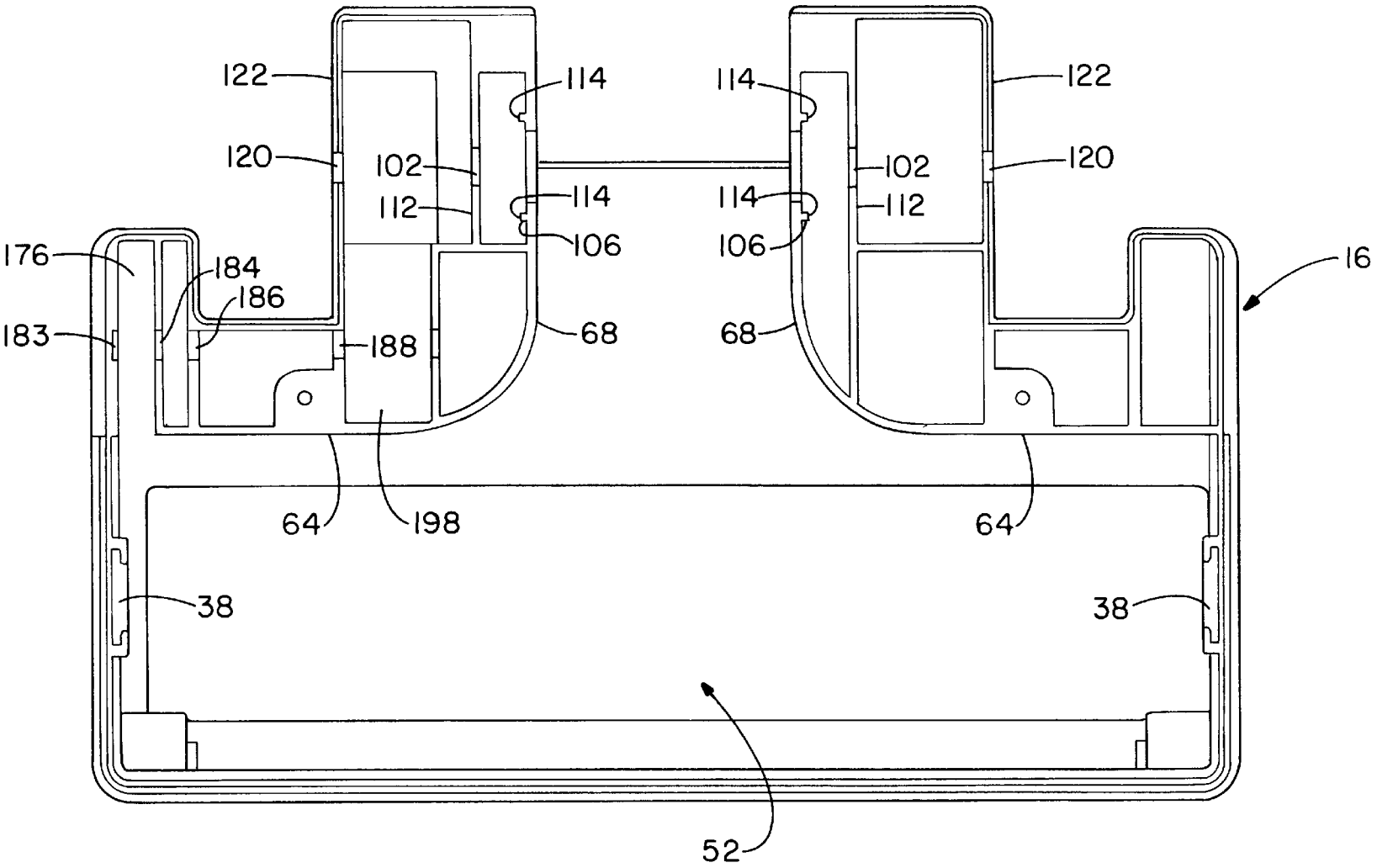
FIG. 3 is a top plan view of the nozzle underbody.
Figure 4:
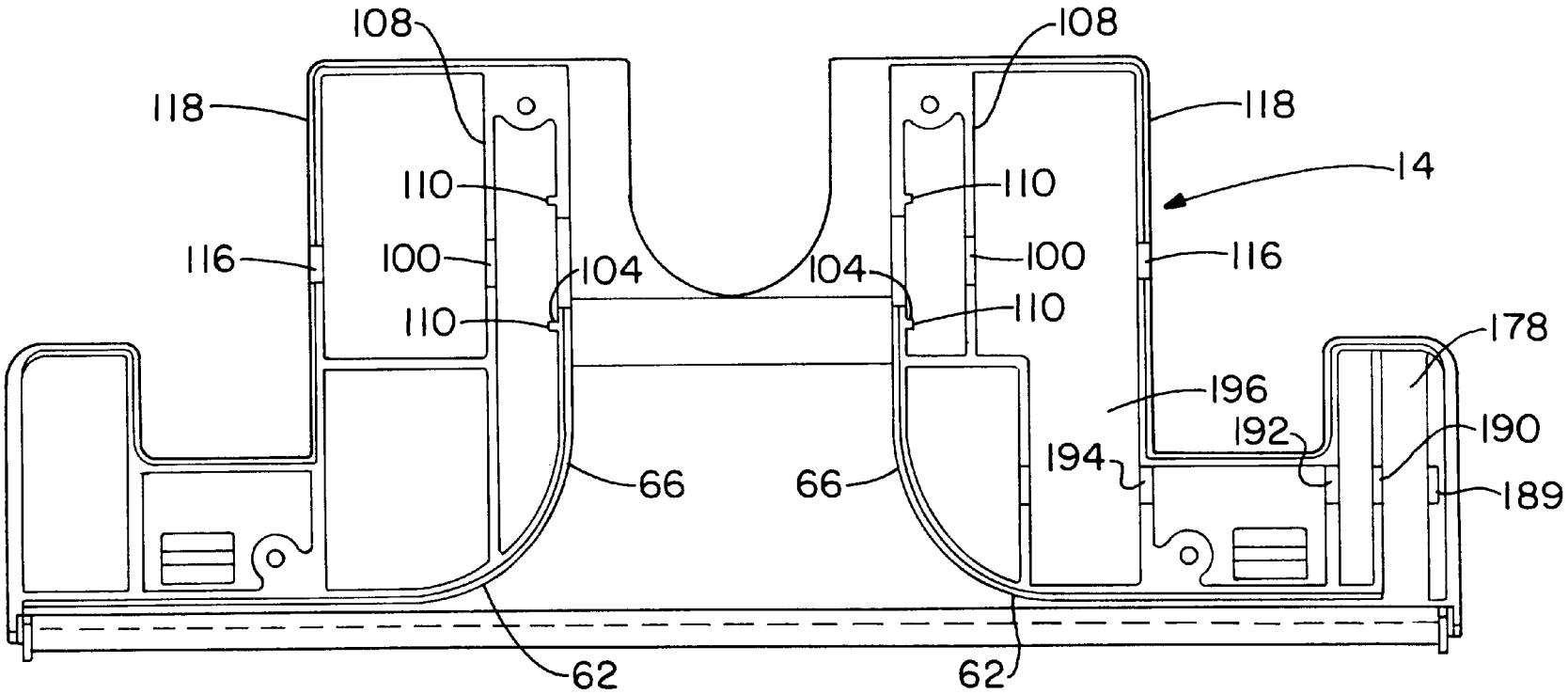
FIG. 4 is a bottom plan view of the nozzle upper body.

A suction cavity 56 formed between the upper and under bodies 14, 16 and lodging the agitator 32 is defined at its front by a upwardly extending wall 58 and end walls 60, 60 on the underbody 16, the front wall 50 of the upper body its top side 47 and its side curvilinear walls 48, 48. At its rear the suction cavity is defined by rear curvilinear walls 62, 62 on underbody 16 and mating rear curvilinear walls 64, 64 on upper body 14. The curvilinear walls 62, 62 and 64, 64 are extended by straight rearwardly disposed wall portions 66, 66, 68 and 68, respectively, (FIGS. 3 and 4) so that streamlined flow of suction air is obtained towards rear portions of suction nozzle 10 formed by nozzle suction tube 70.

Figure 13:
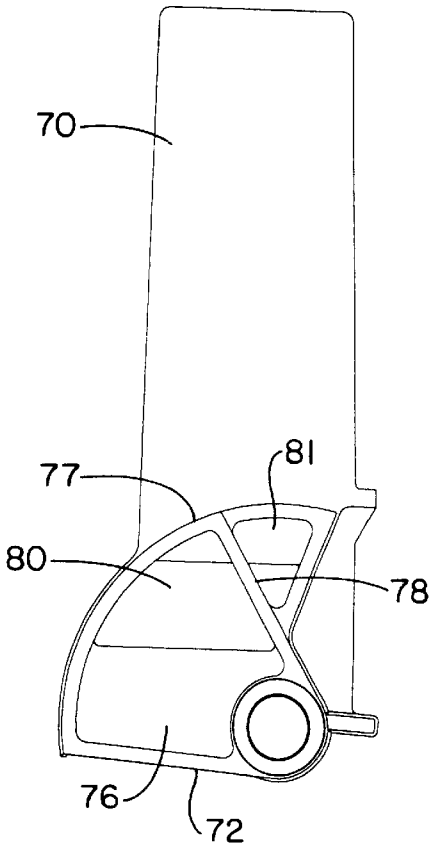
FIG. 13 is a right side elevational view of the suction tube.
Figure 10:
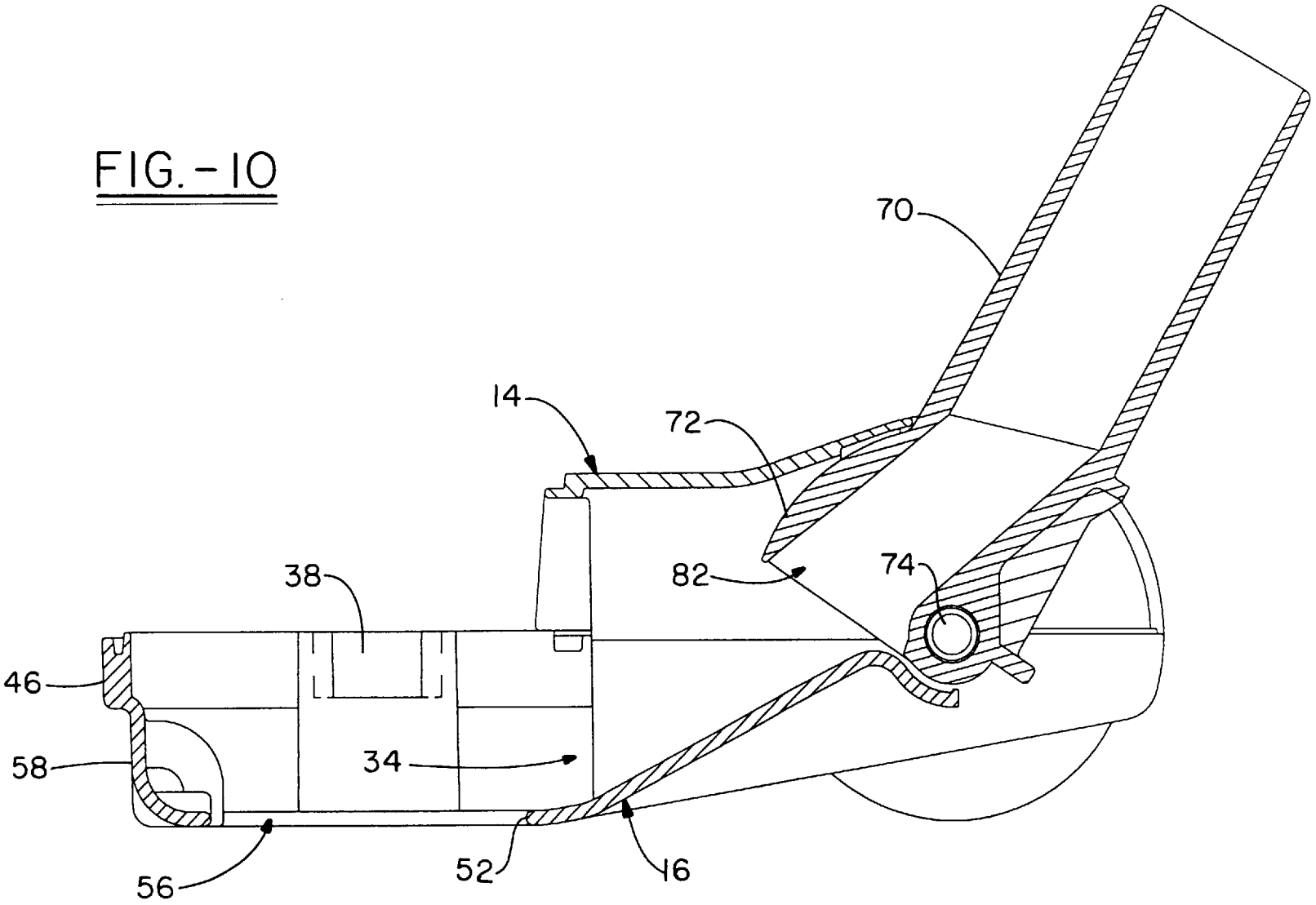
FIG. 10 is a vertical cross-sectional view taken through the center of the wheeled nozzle taken on an axial line through the nozzle hose coupling.
Figure 11:
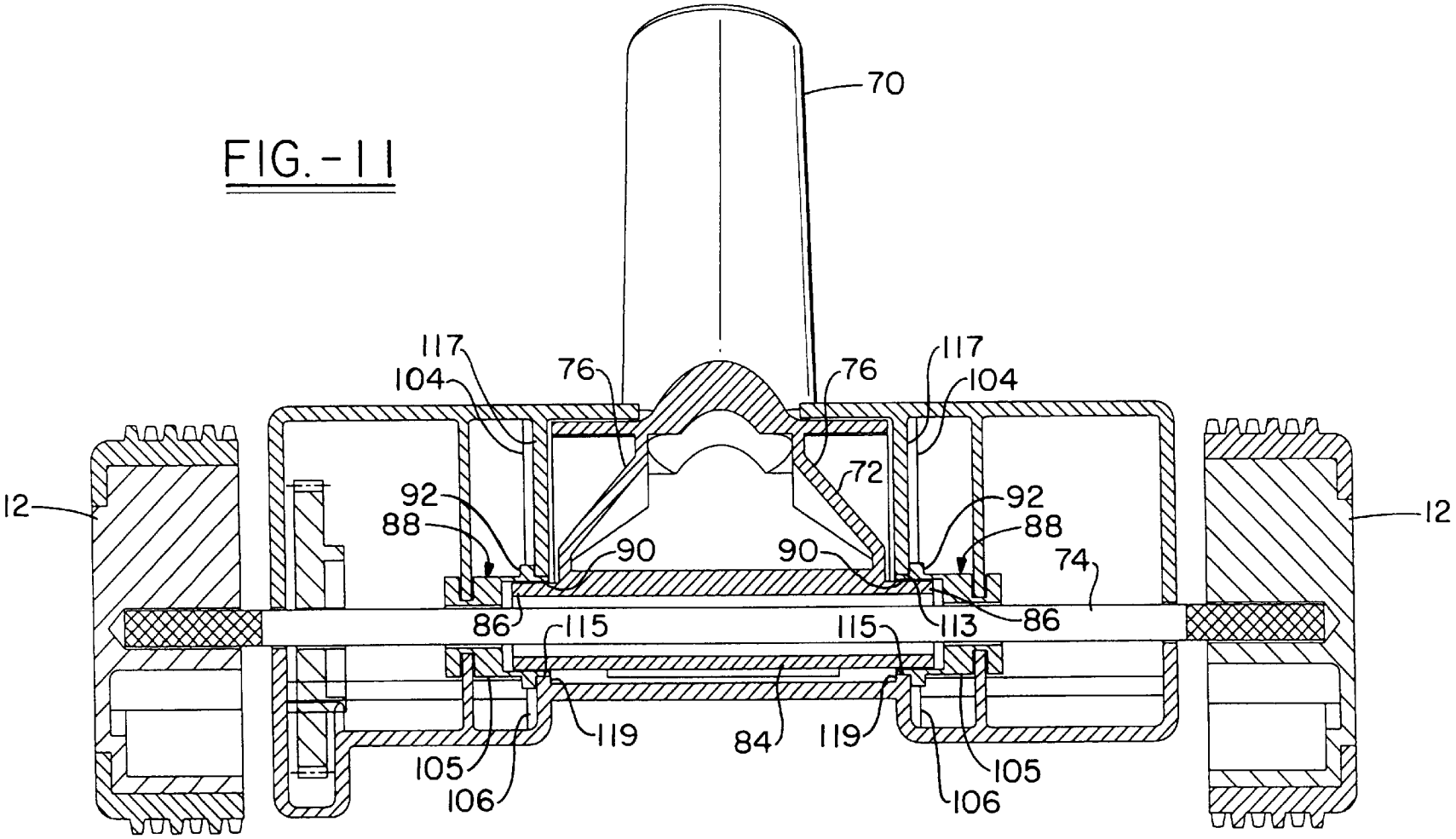
FIG. 11 is a vertical cross-sectional view taken through the wheeled nozzle mediate its wheels.

The suction tube 70 has an inner coupling piece 72 (FIGS. 10 and 11) that is pivoted to the remainder of the nozzle by being rotatably mounted with an axle shaft 74 which non-rotatably mounts the wheels 12, 12 thereto by knurling or the like. The inner coupling piece 72 forms, in cross section (FIG. 11), a substantially right angle sector having stepped reinforced sector ends 76, 76 and a curvilinear top 77 (FIG. 13). The formed right angle insures that the curvilinear top 77 is of sufficient extent to never lose its seal with the remainder of the wheeled nozzle 10. The sector ends 76, 76 each have a transversely angularly extending reinforcing rib 78 and inwardly and upwardly angle sections 80, 81 on each side of the rib 78. These sections, on their inside, form a streamlined merger with a tubular open portion 82 (FIG. 10) of the inner coupling piece 72 of the suction tube 70.

Disposed generally at a downward portion of the inner coupling piece 72, and near its rear, and integral with it, is an axle receiving extended boss 84 (FIG. 11) that includes short protruding boss ends 86. The axle shaft 74 is fit within the axle receiving boss 84 in a centered relationship but is not bearingly maintained by it so that rotation of the axle shaft 74 relative to the inner coupling piece 72 or vice versa has no relative effect on either.

Figure 12:
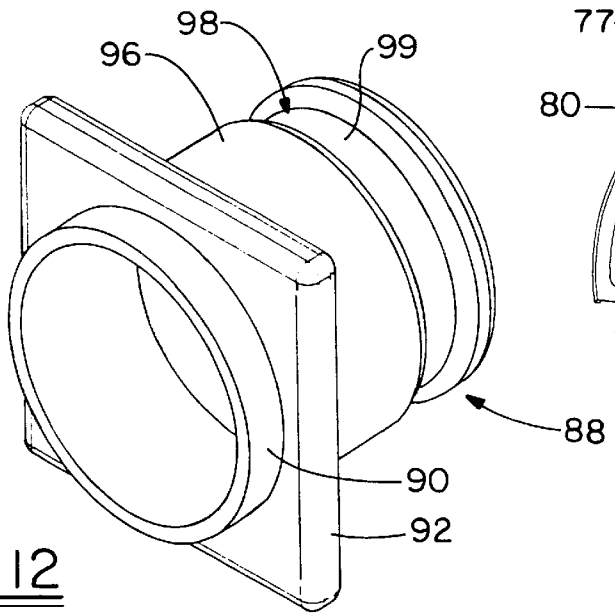
FIG. 12 is a right perspective view of one of the nozzle shaft bearing blocks.

The inner coupling piece 72 is received outwardly bearingly in pilot bearing pieces 88, 88, each of which includes an inner annular lip 90 (FIG. 12) that is received rotationally over outwardly protruding boss ends 86 of inner coupling piece 72. Outwardly of the annular lips 90, the pilot bearing pieces 88, 88 include annularly hollow flanges 92, 92 which are square in elevational view and serve to hold the pilot bearing pieces 88, 88 in a non-rotational relationship with the remainder of the wheeled nozzle 10. Outwardly of the flanges 92, 92, the pilot bearing pieces 88 include an annularly hollow cylindrical portion 96 at each end which has an annular groove 98 formed near the outer end of its linear extent. The annular groove 98 has an inner annular periphery 99.

Each of the upper and under nozzle bodies 14, 16 include half annular wells 100, 100 (FIG. 4) and 102, 102 (FIG. 3), respectively, that receive the inner annular periphery 99 of the annular groove 98 and straight sided wells 104, 104 and 106, 106, respectively, which receive the rectangular outline 105 (FIG. 11) of half of each square flanges 92, 92. The annular wells 100, 100 and the straight sided wells 104, 104 are formed in integral ribs 108,108 (FIG. 4) by the straight ribs 110, 110, 110 and 110 in the upper nozzle body 14. The annular wells 102, 102 and the straight sided wells 106, 106 are formed in integral ribs 112, 112 (FIG. 3) in the under nozzle body 16 and by the straight ribs 114, 114, 114, 114 in the under nozzle body 16. The ribs 108, 108 in the upper nozzle body confront the ribs 112, 1112 in the under nozzle body 16 and the ribs 110, 110 in the upper nozzle body 14 confront the ribs 114, 114 in the under nozzle body to form continuous apertures for full lodgement for the pilot bearing pieces 88.

The cylindrical portions 96, 96 of the pilot bearing piece 88 then extend between the ribs 108, 108, 110, 110, 112, 112 and 114, 114 to space the pilot bearing piece 88 laterally with the annular grooves 98, 98 and square flanges 92, 92 in their engaged positions. The half rounds 113, 113, 115, 115 (FIG. 11) in ribs 117, 117 of upper nozzle body 16 and 119, 119 under nozzle body 14, respectively, also lodge the annular lips 90, 90 of pilot bearings 88, 88.

The axle shaft 74 for the wheels 12, 12, outwardly of the pilot bearing piece 88 extend through and outwardly of half cylindrical apertures 116, 116 (FIG. 4) in inset side walls 118, 118 of upper nozzle body 14 and half cylinder aperture 120, 120 (FIG. 3) in inset side walls 122, 122 in nozzle under body 16. Outwardly of the side walls 118, 118, 122 and 122 the axle shaft 74 fixedly and non-rotationally mounts the wheels 12.

Figure 8:
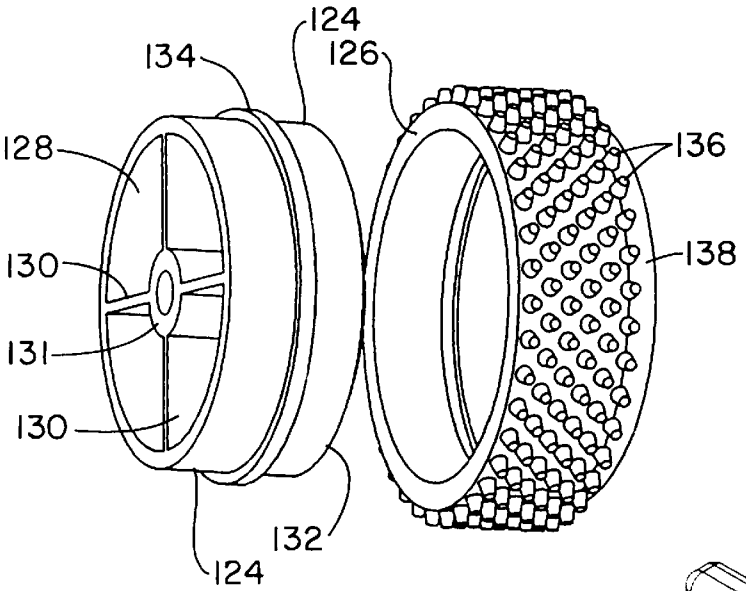
FIG. 8 is a left perspective exploded view of one of the knobbed wheels.

The wheels 12, 12 are shown particularly in FIG. 8 and each include inner wheel rim 124 and an encompassing tire 126. The inner wheel rim 124 includes an inner spoked side 128 having spokes 130, 130, 130 and 130 that extend to and are integral with a wheel hub 131 and with a flat circular face disk 132 on the opposite side of the inner wheel rim 124. An intermediate interrupted peripheral rim bead 134 extending circumferentially around inner wheel rim 124 insures a press interference fit between the inner wheel and the tire 126.

Tire 126 is pipped on its outer surface by integral pips 136, 136, etc. These pips have insufficient columnar strength to remain undeformed when the wheels 12 rotate as the wheeled nozzle 10 moves about during its cleaning function. Pips 136 thereby bend and flex as the wheels 12, 12 rotate so as to increase the rolling coefficient of friction and also to provide a tendency toward self-cleaning (i.e., discharging fluff and the like).

The tire 126 includes for ease in molding, an outer, unpipped surface 138 which extends completely around the periphery of the tire 126. The unpipped surface 138 also includes a vertically extending circular flange 140 (FIG. 1) which engages against the flat face 132 formed on the inner wheel 124 on its outer side. The tire 126 is mounted by stretching it over the inner wheel 124 elastically to deform its inner surface around the interrupted peripheral rim bead 134.

The tire 126, in order to provide deformingly, an increased rolling coefficient of friction and self-cleaning utilizes polyvinyl chloride as it constituent base. Satisfactory deforming of pips made from this material can be had if their truncated conical shape has a root diameter of 0.0935", an upper terminating diameter of 0.0625" and a height of 0.093". The rows of pips each contain three and are offset row by row to obtain a better tractive effort when the wheeled nozzle 10 is maneuvered in its cleaning function. There are 50 rows. The flat section 138 of tire 126 is 0.025" wide. The distance from this edge of the tire to the closest pip is 0.375" and the pips are 0.25" apart centerline to centerline. The total tire width is 0.95".

Figure 9:
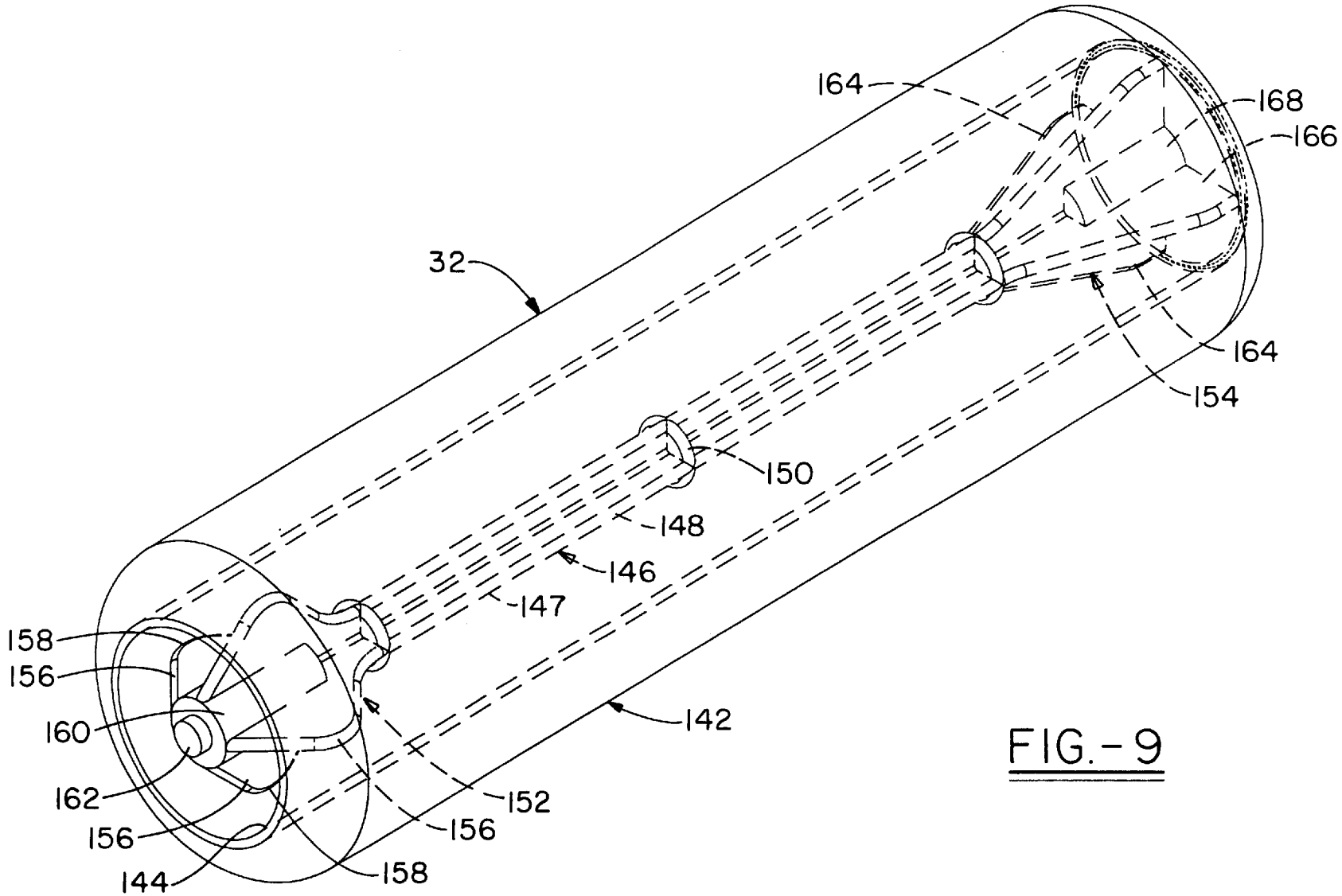
FIG. 9 is a left perspective view of the fluff agitator to be utilized with the suction nozzle.

Agitator 32 is shown in detail in FIG. 9 and may advantageously include a fluffy, cotton-like surface 142 on its outer perimeter if the wheeled nozzle 10 is to be utilized for bare floors. Of course, a differing agitator such as a brush agitator might be utilized for a different cleaning purpose. For the general purpose of this invention, a commercially obtained paint roller configuration may be utilized. It, of course, includes a cylindrically shaped hollow 144 extending for its full length.

Mounted within hollow 144 is a through shaft 146 formed by a first molded web 147 which forms centrally, intersecting arms 148, 148, 148, 148 (only two shown) which are spaced 90° from each other and provide the required strength for the through shaft 146. Intermediate its length, the through shaft also includes a second web 150 that extends perpendicular to each of the arms 148, 148, 148 and 148 and extends therebetween. At this location each of the arms of the web 150 takes the form of quarter of a circular disk.

The ends of the through shaft 146 include integral spider structures 152 and 154. These spider structures terminate the axial length of the arms 148, 148, 148 and 148 at each of the arm's ends. The spider structure 152 (near end of FIG. 9) includes triangular, radially outwardly extending arms 156, 156, 156, 156 of isosceles triangular configuration which are axially aligned with the arms 148, 148, 148 and 148 and have each of their center apexes 158 directed outwardly. The space between the arms 156, 156, 156 and 156 includes an enlarged portion 160 in the event that a steel axle is to be utilized on this end of the through shaft 146 instead of a stub axle 162.

Figure 7:
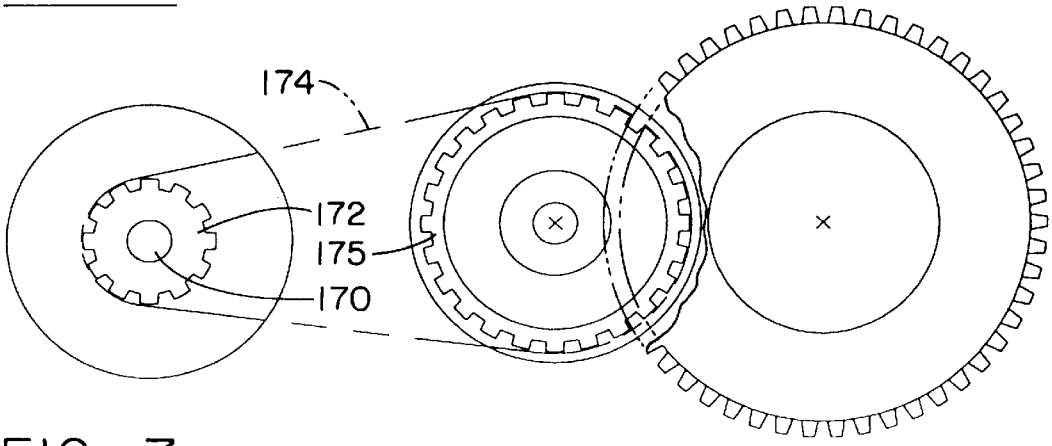

The spider structure 154 (far end of FIG. 9) also includes axially extending arms 164, 164, 164, 164. These arms are also triangular but right triangular in shape and have their enlarged ends towards the outer end of the through shaft 146. This provides a reinforcement for a circular face disk 166 attached integrally thereto (to be more fully described later). Between the arms 164, 164, 164 and 164 is another enlarged portion 168 of the through shaft 146 which permits the possible mounting of a steel shaft within the end of this through shaft 146. An integral stub shaft 170 (FIG. 7) is presently utilized at this end of agitator 32 to rotatably mount it.

Figure 5:
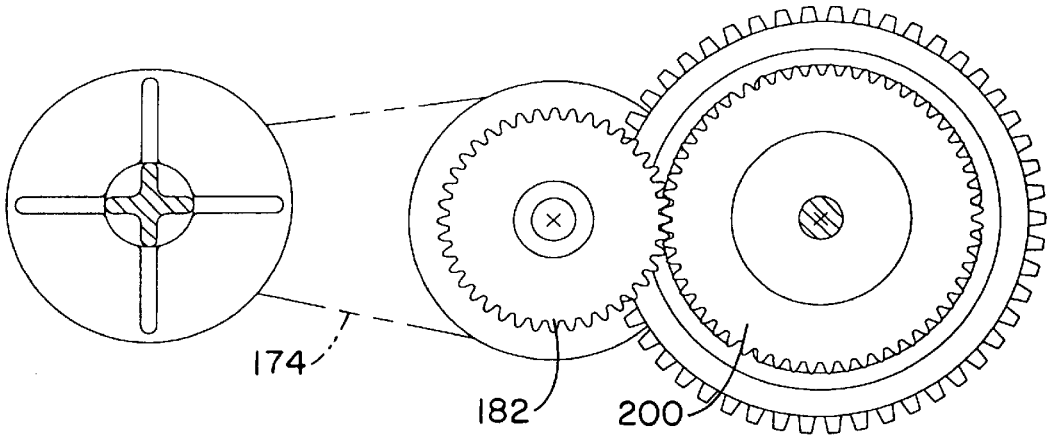
FIGS. 5–7 are various views of the gear and belt driving arrangement of the suction nozzle.
Figure 6:
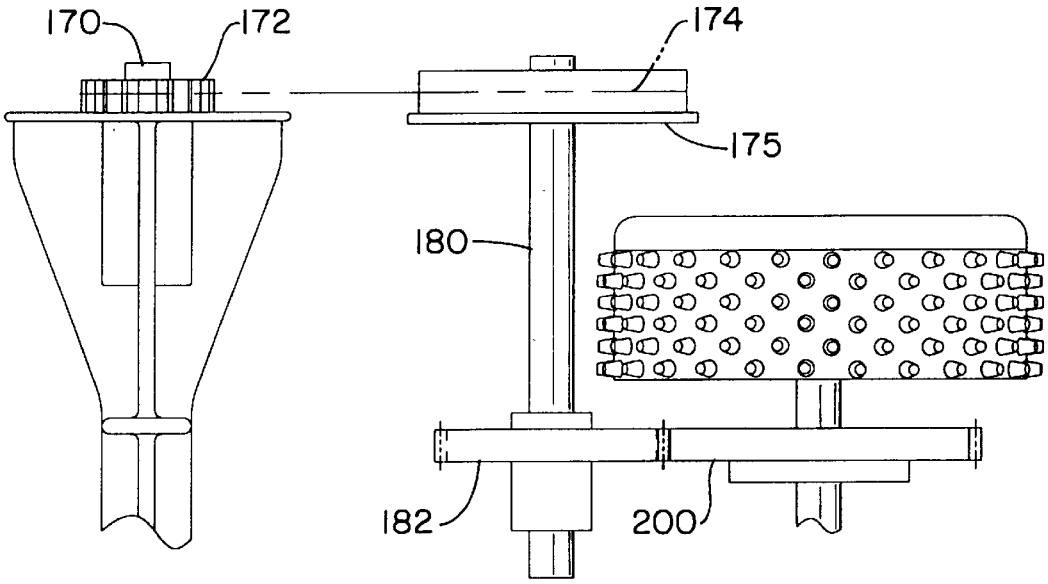

The drive arrangement for the wheeled nozzle 10 is mounted on this end of the agitator 32 by the use of stub shaft 170 which not only bearingly supports agitator 32 but also mounts a small toothed pulley 172 (FIGS. 5–7) which may be fixed to disk in any appropriate manner (not shown). Trained rearwardly on this toothed pulley is a toothed belt 174 which extends over a large toothed pulley 175. The toothed pulley 175 is received half in an upwardly opening bottom pocket 176 in nozzle under body 16 and half in downwardly opening upper pocket 178 formed in upper nozzle body 14.

The toothed pulley 175 is mounted fixedly on a short shaft 180 which also has fixedly mounted adjacent its other end a small gear 182. To provide easy rotation of the gear 182 out large toothed pulley 174, the short shaft 180 is journalled in half rounds 183, 184, 186 and 188 in nozzle under body 16 (FIG. 3) and in half rounds 189, 190, 192 and 194 (FIG. 4) is upper nozzle body 14. The short shaft 180, as is conventional, may be splined or the like to hold the toothed pulley 175 and small gear 182 fast. The small gear 182 rides in pockets 196 and 198 in the upper and under nozzle bodies, respectively.

The small gear 182 is in mesh with a rearwardly disposed large gear 200 which is fixedly mounted on axle shaft 74 to rotate therewith. Knurling or swedging may be utilized to attach this gear . The gear 200 also fits in the pockets 196 and 198.

Operation of the wheeled nozzle 10 over a surface to be cleaned causes the wheels 12, 12 to directly drive the large gear 200 which is in mesh with small gear 182. This reverses the relative rotative directions of the wheels 12 and the agitator 32 and increases the agitator's speed. The gear 182, then, drives the large toothed pulley 175 through their fixed mounting on shaft short shaft 180. The toothed belt 174 forwardly drives small toothed pulley 172 fast with the agitator 32 to provide a second step up in speed. This provides an agitator with a desired significantly higher rate of speed than its wheels and, also, an agitator tending to move dirt inwardly of the wheeled nozzle 10 and through its opening 34 when the nozzle is translated forwardly.

The discussion of the wheeled nozzle is completed by reference to a pair of front small roller wheels 202, 202 situated so as to support the first corners of the wheeled nozzle 10.

It should be clear from the foregoing description that all the objects set out in the beginning portion of the Specification have been met. Further, it should be obvious that many modifications could be made to it which would fall within its spirit and purview.

We claim:

1. A suction nozzle including:

a) a housing having front and rear ends and formed with a cavity adjacent said front end;

b) an agitator removably and rotatably mounted within the cavity;

c) a cover hingedly connected to the housing and movable between an open position which provides access to the cavity allowing for removal of the agitator, and a closed position which covers the cavity preventing removal of the agitator;

d) a front pulley rigidly connected to one end of the agitator whereby rotation of the front pulley drives the agitator;

e) a rear pulley rigidly connected to a shaft, said shaft being rotatably mounted on the housing intermediate the front and rear ends;

f) a belt extending between the front and rear pulleys whereby rotation of the rear pulley drives the front pulley, said belt being partially accessible when the cover is in the open position;

g) a front gear rigidly connected to the shaft whereby rotation of the front gear drives the shaft and rear pulley;

h) a rear wheel rotatably connected to the housing adjacent the rear end thereof; and i) a rear gear rigidly connected to the rear wheel, said rear gear engages the front gear whereby rotation of the rear wheel drives the front gear.

2. The nozzle found in claim 1 in which the rear gear has a diameter larger than a diameter of the front gear.

3. The nozzle found in claim 1 in which the rear pulley has a diameter larger than a diameter of the front pulley.

4. The nozzle found in claim 1 in which the front and rear pulleys and belt are cogged.

5. The nozzle found in claim 1 in which the agitator is formed of a fluff material allowing the nozzle to clean and shine bare floors.

6. The nozzle found in claim 1 in which the rear wheel is pipped to include a plurality of outwardly extending pips around an outer periphery thereof.

7. The nozzle found in claim 6 in which the pips are generally conical in shape and have a truncated outer end.

8. The nozzle found in claim 7 farther including a pair of pipped rear wheels.

9. The nozzle found in claim 1 further including a cylindrical-shaped axle extending from opposed ends of the agitator.

10. The nozzle found in claim 9 in which a curved slot is formed in opposed side walls of the housing, said curved slots having an open top end for receiving the cylindrical axles of the agitator.

11. The nozzle found in claim 10 in which the cover includes downwardly extending side walls which enclose the open top end of the slots when the cover is in the closed position for retaining the agitator rotatably in the cavity.

12. The nozzle found in claim 1 in which the agitator rotates in a direction opposite that of the rear wheel when the suction nozzle is moved across a bare floor.

13. A wheel driven suction nozzle including:

a) a housing having front and rear ends, a pair of opposed side walls and formed with a cavity adjacent said front end;

b) an agitator having a soft fluff material on an outer surface thereof for cleaning and shining a bare floor, said agitator is removably and rotatably mounted within the cavity at a pair of ends of said agitator;

c) a cover hingedly connected to the housing and movable between an open position which provides access to the cavity and allows for removal of the agitator, and a closed position which covers the cavity and prevents removal of the agitator;

d) a recess formed in each side wall of the housing for receiving an end of the agitator, said recesses allowing for vertical removal of the agitator when the cover is in the open position;

e) a latch for releasably retaining the cover in the closed position; and f) a rear wheel operatively connected to the agitator whereby rotation of said rear wheel rotates the agitator.

14. The nozzle found in claim 13 in which the rear wheel is pipped to include a plurality of outwardly extending pips around an outer periphery thereof.

15. The nozzle found in claim 13 further including a cylindrical-shaped axle extending from opposed ends of the agitator.

16. The nozzle found in claim 15 in which each recess is formed as a curved slot formed in the opposed side walls of the housing, said curved slots having an open top end for receiving the cylindrical axles of the agitator.

17. The nozzle found in claim 13 in which the agitator rotates in a direction opposite that of the rear wheel when the suction nozzle is moved across the bare floor.

18. The wheel driven suction nozzle defined in claim 13 in which at least one of the recesses is formed with a top slotted opening which provides for sliding vertical removal of the agitator from the cavity when the cover is in the open position.

19. A wheel driven suction nozzle including:

a) a housing having front and rear ends and formed with a cavity adjacent said front end;

b) an agitator having a soft fluff material on an outer surface thereof for cleaning and shining a bare floor, said agitator is removably and rotatably mounted within the cavity;

c) a cover hingedly connected to the housing and movable between an open position which provides access to the cavity and allows for removal of the agitator, and a closed position which covers the cavity and prevents removal of the agitator;

d) latching means for releasably retaining the cover in the closed position; and e) a rear wheel operatively connected to the agitator whereby rotation of said rear wheel rotates the agitator, said rear wheel being pipped to include a plurality of outwardly extending pips around an outer periphery thereof, said pips being generally conical in shape and have a truncated outer end.

20. The nozzle found in claim 19 further including a pair of pipped rear wheels.

21. A wheel driven suction nozzle including:

a) a housing having front and rear ends and formed with a cavity adjacent said front end;

b) an agitator having a soft fluff material on an outer surface thereof for cleaning and shining a bare floor, said agitator is removably and rotatably mounted within the cavity;

c) a cover hingedly connected to the housing and movable between an open position which provides access to the cavity and allows for removal of the agitator, and a closed position which covers the cavity and prevents removal of the agitator;

d) latching means for releasably retaining the cover in the closed position;

e) a rear wheel operatively connected to the agitator whereby rotation of said rear wheel rotates the agitator;

f) a cylindrical-shaped axle extending from opposed ends of the agitator;

g) in which a curved slot is formed in opposed side walls of the housing, said curved slots having an open top end for receiving the cylindrical axles of the agitator; and h) in which the cover includes downwardly extending side walls which enclose the open top end of the slots when said cover is in the closed position, said side walls retain the agitator within the cavity when the cover is in the latched position.

* * * * *